United States Patent [19]

Fixler

[11] 4,303,055

[45] Dec. 1, 1981

[54] WASTE OIL HEATER HAVING FUEL CONTROL SYSTEM

[76] Inventor: Stanley Fixler, P.O. Box 182, Rockaway, N.Y. 14602

[21] Appl. No.: 110,265

[22] Filed: Jan. 7, 1980

[51] Int. Cl.[3] ..... F24C 5/00; F23N 5/00

[52] U.S. Cl. ..... 126/93; 431/78

[58] Field of Search ..... 126/93; 431/79, 78

[56] References Cited

U.S. PATENT DOCUMENTS

| | | | |
|---|---|---|---|
| 2,775,966 | 1/1957 | Huntley | 126/93 |
| 3,666,392 | 5/1972 | Julinot | 431/78 |
| 3,959,697 | 5/1976 | Bauer et al. | 431/79 |
| 4,015,927 | 4/1977 | Culpepper, Jr. | 431/79 |
| 4,116,614 | 9/1978 | Kutrieb | 431/89 |

*Primary Examiner*—Samuel Scott
*Assistant Examiner*—Wesley S. Ratliff, Jr.
*Attorney, Agent, or Firm*—Jordan and Hamburg

[57] ABSTRACT

An oil heater comprises an oil burning section and an oil feeding system for feeding oil from a tank to the burning section. The oil feeding system includes pump means and motor means for operating the pump means. A control system of the oil feeding system consists essentially of relay means situated in a line between the motor means and electric source, combustion detecting means provided in the burning section to detect combustion of oil, and thermoresponsive switch means situated in the line between the relay means and the electric source for operating the relay means and the detecting means after combustion of oil in the burning section. The combustion detecting means is connected to the relay means to allow electric current to pass through the relay means from the electric source to the motor means only when the detecting means detects combustion of oil.

2 Claims, 3 Drawing Figures

FIG. 1
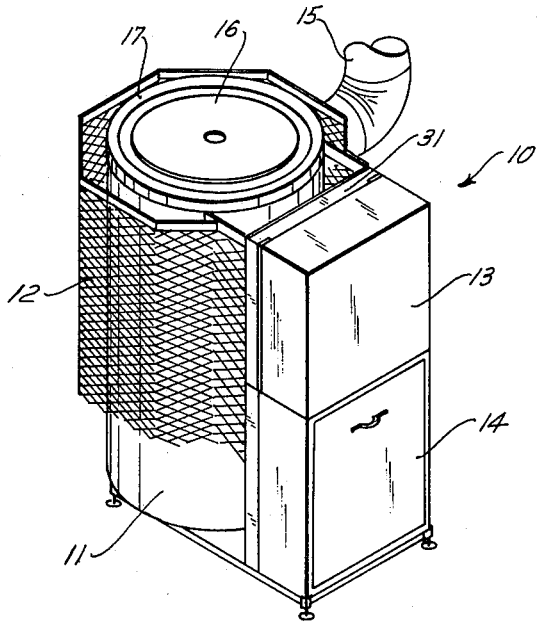
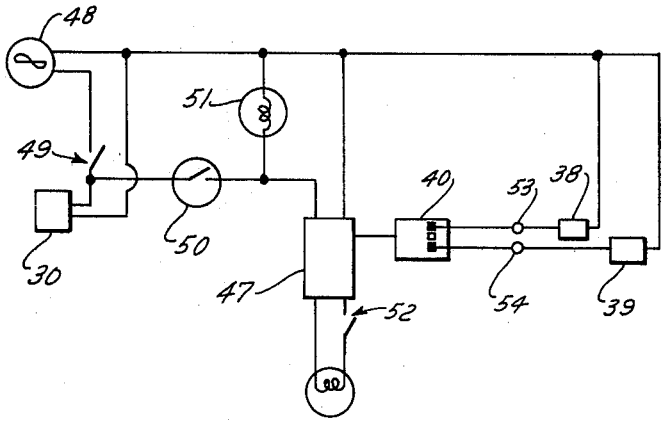
FIG. 3

WASTE OIL HEATER HAVING FUEL CONTROL SYSTEM

REFERENCE to DISCLOSURE DOCUMENT

This invention is also the subject of Disclosure Document No. 084,546, filed Sept. 18, 1979.

BACKGROUND of the INVENTION and PRIOR ART STATEMENT

The invention relates to a waste oil heater having a fuel control system, more particularly a waste oil heater of a type in which the fuel supply is automatically stopped when the fire in the burner suddenly extinguishes. Waste oil heaters are very important in the national conservation effort because it is estimated by the U.S. Department of Commerce, National Bureau of Standards that there is in excess of 1 and perhaps as much as 2 billion gallons per year of waste oil produced in the U.S., most of which is dumped on the ground, becoming a serious pollutant. Waste oil heaters burn this oil, without processing, cleanly and effectively.

In oil heaters, oil is supplied from a fuel tank to the burner, at which oil is vaporized by heat or atomized by ejection from a nozzle for completely burning oil. Waste oil generally includes many impurities which do not burn and cannot pass through a small conduit or valve. Therefore, when waste oil is to be burned, it is at first supplied to a vaporizer pan and is vaporized by heat thereat. That is, waste oil can be burned conveniently only in a vaporization type oil heater. Such oil heaters are provided with a pan to which the oil is fed and in which the oil is heat vaporized; the pan is commonly known as a "pot" or "retort". Consequently, such heaters are known as "pot type heat vaporizing oil heaters."

U.S. Pat. No. 4,116,614 discloses a waste oil heater of the type described above, in which waste oil is supplied to a vaporizer pan in a mantle by means of a pump operated by a reversible motor. The pump is connected through a rod to a cam block having short and long stroke channels, and the cam block is rotated by the motor. The rod engages either one or the other of the channels according to the rotational direction of the cam block, i.e., the fuel supply volumetric rate is regulated by the rotational direction of the motor. The rotational direction of the motor is selected by a thermostat.

The above waste oil heater is not sufficiently safe to meet U.S. standards. For example, if the fire in the burner extinguishes because the oil in the pan does not vaporize at a sufficient rate due to excessive contamination thereof or the oil being of too heavy a grade, the vaporizer pan continues to be filled with waste oil and oil overflows therefrom.

Accordingly, an object of the invention is to provide an oil heater of a type in which the fuel supply is stopped when the fire in the burner extinguishes.

Another object of the invention is to provide an oil heater as stated above, in which fuel control system is simply constructed and is accurately actuated.

Other objects and advantages of the invention will be apparent from the following description of the invention.

SUMMARY OF THE INVENTION

In accordance with the invention, there is provided an oil heater including an oil burning section and an oil feeding system for feeding oil from a tank to the burning section. In the oil burning section, oil is at first vaporized and is then burned, and the oil feeding system includes pump means and electric motor means for operating the pump means. The oil heater of the present invention is provided with a control system for the oil feeding system. The control system consists essentially of relay means situated in a line between the motor means and the source of electricity, combustion detecting means provided in the burning section to detect combustion of oil, and thermo-responsive switch means situated in the line between the relay means and the source of electricity for operating the relay means and the combustion detecting means after combustion of oil in the burning section. The combustion detecting means is connected to the relay means to allow electric current to pass through the relay means from the source of electricity to the motor means only when the detecting means detects combustion of oil.

The oil heater of the invention further includes indicator means for showing on-off condition of the thermo-responsive switch means, and an operating switch for operating the combustion detecting means. The operating switch is closed after the thermo-responsive switch is turned on. The heater is also provided with an air blower for supplying air to the oil burning section and a main control switch which is turned on when oil is ignited in the burning section. The air blower is operated by the main control switch.

For operating the oil heater, oil is added to the burning section and is ignited by a match or the like. Thereafter, the main control switch is turned on so that air blower is operated to supply air to the oil burning section. When the burning section is sufficiently warmed, the thermo-responsive switch automatically operates to thereby turn on the indicator means. Then, the operating switch is turned on for actuating the combustion detecting means. The pump means is automatically operated when the thermo-responsive switch is turned on feed oil to the burning section, but if the operating switch is not turned on within a predetermined time, the relay means operates to turn off the line thereof so that the pump means stops.

The oil heater of the invention includes a thermostat for controlling the motor means to supply oil to the burning section in response to room temperature. The motor means comprises a high speed motor and a low speed motor, which are actuated such that the high speed motor operates to feed oil to the burning section at a greater rate when the room temperature falls to the lower limit, and the low speed motor operates to feed oil at a lesser rate to the burning section when the room temperature raises to the upper limit. As stated above, when the heater is operated, temperature is automatically controlled. As an alternative to the use of two motors, i.e., a high speed motor and a low speed motor, there may be used one two-speed motor.

BRIEF DESCRIPTION OF THE DRAWINGS

FIG. 1 is an exterior perspective view of the oil heater in accordance with the invention;

FIG. 3 is a schematic diagram of the fuel control system of the oil heater.

DETAILED DESCRIPTION OF A PREFERRED EMBODIMENT

Figure 2:
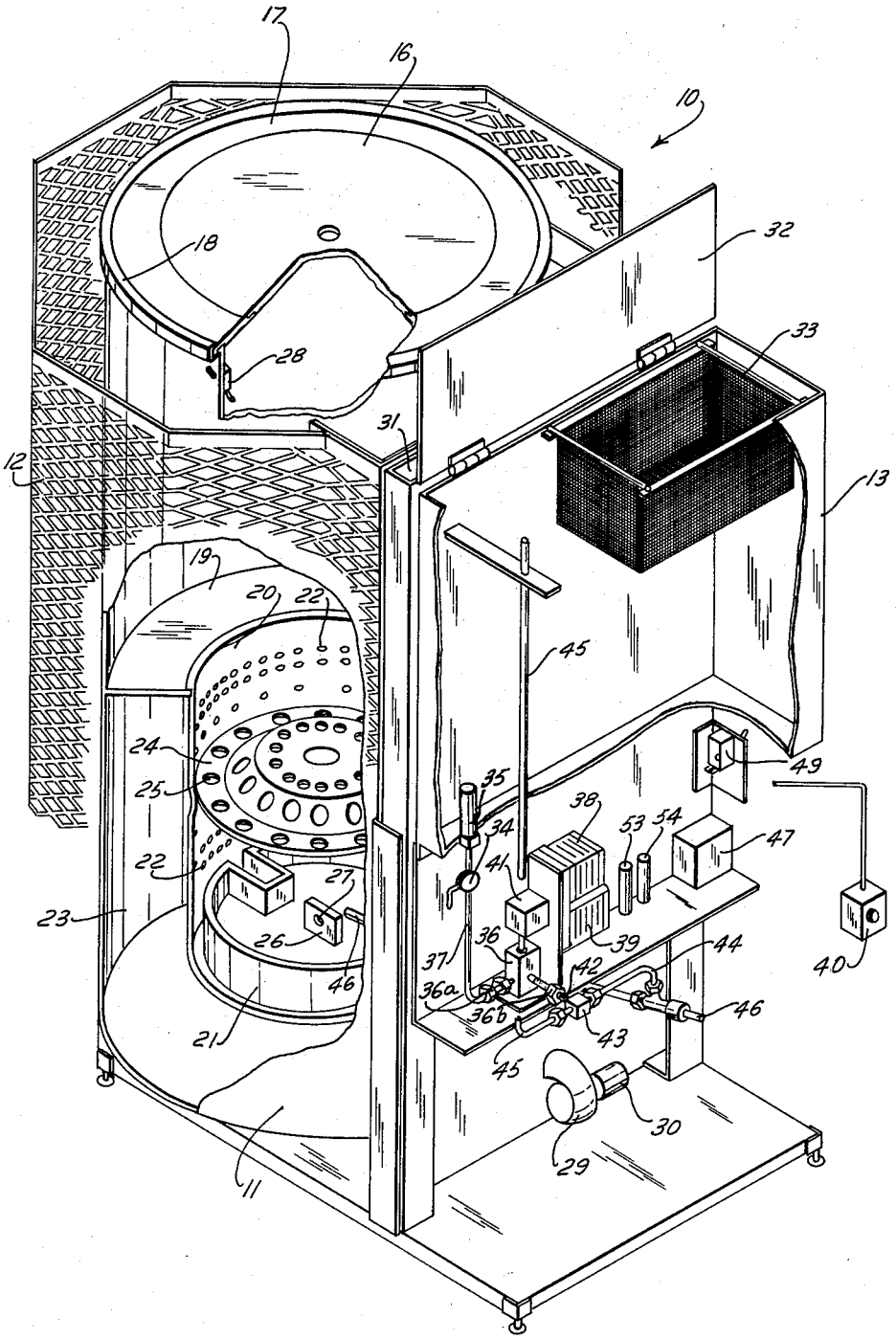
FIG. 2 is a perspective view of the oil heater in which several parts are broken away to show the interior thereof.

Referring to FIGS. 1 and 2, there is shown an oil heater 10 in accordance with the present invention, in which waste oil, such as used engine oil, can be used as a fuel. The oil heater 10 includes a cylindrical body 11, an outer cover 12 and a fuel tank 13. A fuel control system is generally situated in a control box 14 below the fuel tank 13. A vent 15 is connected to an upper portion of the body 11 and combustion gas is exhausted therethrough.

The body 11 includes inner and outer lids 16, 17. The outer lid 17 is immovably attached to the body 11 by means of a band 18, while the inner lid 16, which is received in the outer lid 17 by bayonet mounting, can be removed from the outer lid 17 for firing oil at first. Inside the body 11, a support ring 19 is provided, in which a cylindrical burner 20 is removably situated. The burner 20 includes at the bottom part a vaporizer pan 21 and a plurality of small holes 22 around the periphery thereof. The burner 20 defines a space 23 together with the support ring 19 and the body 11, through which fresh air from the outside is supplied to the burner 20. In the center of the burner 20, a fire plate 24 having a plurality of small openings 25 is removably situated. The vaporizer pan 21 includes a projection 26 having a hole 27 for periodically taking out the burner 20 from the body 11 by means of a wire hook (not shown) to clean the pan 21. Inside the body 11, there is also provided a flame sensor 28 to detect fire in the burner 20, which is explained in detail hereinafter. The flame sensor 28 is located generally opposite the vent 15, i.e., on the negative draft side, and/or is embedded in a heat sink in order that it not be damaged by high heat resulting from the combustion. The flame sensor 28, e.g., a cadmium sulfide cell may be supported by a bracket in a tube extending through the wall of the body. The tube and hence the sensor 28 is aimed directly at the center of the fire plate 24. If the tube is left open, a flow of air therethrough is induced due to the location thereof on the negative draft side of the body 11 and this air flow helps keep the sensor 28 cool. (If a heat sink is used, this will generally close the tube but in itself will protect the sensor 28 from excessive heat.)

An air blower 29 operated by a motor 30 is situated in the control box 14, and fresh air passing through a path 31 between the tank 13 and the body 11 and entering the control box 14 is supplied to the space 23. Passage of air through path 31 decreases the transmission of heat from the body 11 to the oil tank 13, thereby preventing potentially dangerous heating of the tank 13. This air path also satisfies the U.S. safety requirement that the air intake be at least 18 inches above floor level (since hydrocarbon fumes are usually heavier than air).

The oil tank 13 includes a lid 32 and a filter 33, and waste oil is supplied thereto through the filter 33 to remove impurities. A pipe 37 communicates between the bottom of the tank 13 and a pump 36. A removable secondary oil filter 35 is provided at the end of the pipe 37 within the tank 13. In the pipe 37 is provided an oil inlet valve 34. At the inlet to and outlet from the pump 36 are respective check valves **36*a* and 36*b* to prevent reverse flow of oil when the pump 36 is operating or leaking of oil when the pump 36 is at rest. The pump 36 is operated by a high speed motor 38 or a low speed motor 39 selected by a thermostat 40. A gear box 41 transfers power of either one of the motors 38, 39 via a cam (not shown) to the pump 36. A pipe 42 is situated between the pump 36 and a two-way connector 43, from which two pipes 44, 45 extend. The pipe 44 is connected to a feeding pipe 46 extending into the vaporizer pan 21, while the pipe 45 returns to the tank 13, so that when the pipe 44 or 46 is clogged due to impurities suspended in waste oil, oil sent by the pump 36 is returned to the tank 13 through the pipe 45. Accordingly, if clogging occurs, no damage is incurred by the pump 36 or the motors 38, 39**.

Referring to FIG. 3, showing a schematic diagram of the fuel control system, there is provided a relay 47 which allows electric current to pass from an electric source 48 to the thermostat 40 in response to the flame sensor 28. The relay 47 and the flame sensor 28 are preferably of types sold by Honeywell, Model R8184G and C554A, respectively, or similar.

The fuel control system includes a main control switch 49 which controls the electric part of the system. The motor 30 of the air blower 29 is, therefore, actuated by the switch 49. A thermo-responsive switch 50 is situated in a line between the switch 49 and the relay 47, and a lamp 51 is situated parallel to the relay 47 for indicating on-off condition of the switch 50. The switch 50 is provided near the body 11 for closing in response to heat produced by burning of oil. When the switch 50 is closed by the heat, electric current flows from the electric source 48 to the relay 47 through the switches 49, 50 and returns to the electric source 48. At the same time, electric current also flows to the thermostat 40. But the relay 47 operates such that if an operating switch 52 of the flame sensor 28 is not closed within a predetermined time, the relay 47 opens whereby electric current does not flow to the thermostat 40. The relay 47 also opens the circuit when the sensor 28 does not detect burning of oil in the burner during operation. The relay 47 includes a reset switch (not shown) for changing the open-condition circuit to the closed condition to pass electric current to the thermostat 40 again. In any event, when the lamp 51 indicates that the switch 50 is closed, the switch 52 must be closed within 45 seconds.

The thermo-responsive switch 40 is provided for the purpose that the relay 47 should be put into operation once the oil is burning steadily in the burner. Namely, if the sensor 28 is operated before flame in the burner is stabilized, the sensor 28, in this case a cadmium sulfide cell, sometimes cannot detect flame, due to limitations of its sensitivity, to thereby operate the relay 47 to open the circuit. The switch 52 is also provided for putting the sensor 28 into operation after the relay 47 is actuated. The sensor or cadmium sulfide cell is otherwise known as a photoelectric cell; in theory, other flame detecting devices can be used, which, for example, detect infra-red radiation, ultraviolet radiation or ionization (instead of visible light).

Electric current flowing to the thermostat 40 is transmitted to one of the motors 38, 39 to operate the pump 36 for feeding oil from the tank 13 to the vaporizer pan 21. The thermostat 40 can be placed in any position in a room and operates so than when the temperature of the room is below the predetermined level, electric current flows to the high speed motor 38 to feed oil at a greater rate to the pan 21, and, on the contrary, when the room temperature is high enough, electric current flows to the low speed motor 39 to feed oil to the pan 21 at a lesser rate. Capacitors 53, 54 are respectively provided for the motors 38, 39.

In operating the heater 10, the lid 16 is at first opened and one or two cups of waste oil is poured into the vaporizer pan 21. Thereafter, oil is ignited by means of a match or burning paper, and the lid 16 is closed. The main control switch 49 is at this time turned on to thereby operate the motor 30 of the air blower 29 to feed air to the burner 20. The reset switch is also turned on. When the lamp 51 lights to indicate closing of the thermo-responsive switch 50, the operation switch 52 is closed, so that fuel is continuously fed to the vaporizer pan 21.

When the heater 10 is shut down, the switch 52 is opened to thereby operate the relay 47 not to feed electric current to the thermostat 40. Consequently, the motor is stopped and the fire is extinguished. Then the main control switch 49 is turned off and the valve 34 is closed.

The invention has been described with reference to a specific embodiment, but it is to be understood that the description is illustrative and the invention is limited only by the appended claims.

What I claim is:

1. In a pot type heat vaporizing oil heater including an oil burning section and an oil feeding system for feeding oil from a tank to the burning section, said oil feeding system having pump means for pumping oil to the burning section, motor means for operating the pump means, and terminals adapted to be connected to an electric source; the improvement comprising a control system for the oil feeding system, said control system comprising relay means and thermo-responsive switch means connected between said motor means and said terminals, combustion detecting means mounted in the burning section to detect combustion of oil, said detecting means being connected to said relay means to allow electric current to pass through the relay means from the terminals to the motor means when said detecting means detects combustion of oil, said thermo-responsive switch means being connected to enable operation of said relay means and said detecting means only when the combustion of oil in the burning section is stably established, and further including indicator means connected to indicate the on-off condition of said thermo-responsive switch means, and an operating switch for connecting said combustion detecting means to said relay means.

2. In a pot type heat vaporizing oil heater having burner means, pump means for feeding oil to said burner means, motor means for operating said pump means, switch means responsive to the temperature in said burner means, and means connecting said switch means to energize said pump means only when combustion is present in said burner means; the improvement comprising flame detector means mounted to detect the presence of flames in said burner means, said connecting means comprising control means coupled to said flame detector means and responsive to the detection of flame thereby for energizing said pump means by way of said switch means, and a flame detector switch, said control means being coupled to said flame detector means by way of said flame detector switch, said control means having a reset control enabling energizing of said pump means for a determined period of time following operation of said switch means.

* * * * *